United States Patent [19]

Sotoma

[11] 4,060,109

[45] Nov. 29, 1977

[54] FILLING QUANTITY REGULATING SYSTEM IN CONTAINER FILLING APPARATUS

[75] Inventor: Koichi Sotoma, Yokohama, Japan

[73] Assignees: Kewpie Kabushiki Kaisha, Tokyo; Toyo Shokuhin Kikai Kabushiki Kaisha, Kanagawa, both of Japan

[21] Appl. No.: 686,262

[22] Filed: May 14, 1976

[51] Int. Cl.[2] ..... B65B 3/28; B65B 3/32

[52] U.S. Cl. ..... 141/83; 141/152; 177/50; 222/308

[58] Field of Search ..... 141/1, 98, 138, 144–152, 141/177, 266, 276, 367, 376, 83, 183–191; 222/296, 308, 309, 77; 177/50, 58; 417/517, 519

[56] References Cited

U.S. PATENT DOCUMENTS 3,835,898 9/1974 Leonard ..... 141/152

*Primary Examiner*—Richard E. Aegerter
*Assistant Examiner*—Frederick R. Schmidt
*Attorney, Agent, or Firm*—Oblon, Fisher, Spivak, McClelland & Maier

[57] ABSTRACT

In a container filling apparatus having a plurality of revolving charging cylinders and respective pistons by which a fluid material supplied into the cylinders with their pistons at the limit end of their intake strokes is subsequently pushed out of the cylinders to fill respective containers, an adjusting screw is provided to set by its one end the limit of the intake stroke of the piston rod of each piston and has a sprocket-like wheel fixed to its other end and actuated in incremental rotation by the piston rods of stationary air cylinders fixed to the apparatus frame when the wheel, revolving with its cylinder, is engaged by the piston rods. The activation of the air cylinders is controlled by electrical control means by which the limit of the intake stroke of any piston and, therefore, the filling quantity of the corresponding cylinder can be adjusted without danger and without stopping the operation of the apparatus.

9 Claims, 9 Drawing Figures

FILLING QUANTITY REGULATING SYSTEM IN CONTAINER FILLING APPARATUS

BACKGROUND OF THE INVENTION

This invention relates to improvements in apparatuses for charging or filling containers with fluid substances (hereinafter referred to as filling apparatuses) and more particularly to a filling quantity regulating system capable of automatically adjusting filling quantities in a filling apparatus.

In the prior art there have been filling apparatuses of the type in which a fluid substance to be charged into containers is introduced into a plurality of charging cylinders and is then pushed out by respective pistons in metered quantity into corresponding containers.

In an apparatus of this class, when deviations in the filling quantity occur from cylinder to cylinder, or when fluctuations in the filling quantity of all cylinders occur, it has heretofore been the practice to adjust the filling quantity by manually varying the limit position of retraction or intake stroke of each piston, thereby to adjust the volume within the cylinder for introduction of the material to be charged. In the case of a so-called rotary type filling apparatus in which charging cylinders are disposed in a ring around a main spindle or shaft to revolve thereabout, the above mentioned adjustment during operation is accompanied by danger and is practically impossible since all cylinders are undergoing revolution around the main shaft. Consequently, there is the inconvenient necessity of stopping the operation of the apparatus each time an adjustment is to be made.

The above mentioned fluctuation in the filling quantity occurs as a result of causes such as subtle variations in the states of seals of the pistons and fluctuations in sepcific gravity due to subtle variations in conditions, such as the blending of the material being charged and the environmental temperature. As a consequence, the above mentioned adjustment of filling quantity must be carried out relatively frequently. This gives rise to an undesirable drop in operational efficiency due to frequent stoppages of the apparatus. Of course, a filling quantity regulating system adapted for the container filling apparatus as mentioned above and comprising a specific limit adjusting mechanism, for example, such system as disclosed in U.S. Pat. No. 3,835,898 has been proposed for eliminating the disadvantages mentioned above. However, a conventional system is relatively complex and expensive.

SUMMARY OF THE INVENTION

It is an object of this invention to solve the above described problem by providing a filling quantity regulating system in a filling apparatus of the above mentioned character having an improved limit adjusting mechanism combined with a specific actuating device for adjustably actuating such mechanism and driving means for activating the actuating device, which can cause automtic, accurate, simple and inexpensive adjustment of the filling quantity of each charging cylinder, even during operation of the filling apparatus.

According to this invention, briefly summarized, there is provided, in a filling apparatus of the character referred to above, a filling quantity regulating system comprising: a limit adjusting mechanism provided for each of the cylinders and provided with a finely adjustable member having a contact surface for abutment thereagainst by a part of a piston rod secured to the piston of that cylinder thereby to set adjustably the position of the limit end of the intake stroke of the piston; an actuating device having actuating means operating upon being activated to adjust the finely adjustable member of any of the cylinders; and control means for activating the actuating means of any cylinder, thereby to adjust the position of the limit end of the intake stroke of the piston of that cylinder and thereby to adjust the filling quantity of that cylinder.

The nature, utility, and further features of this invention will be more clearly apparent from the following detailed description with respect to preferred embodiments of the invention when read in conjunction with the accompanying drawings, throughout which like parts are designated by like reference numerals.

DETAILED DESCRIPTION OF THE INVENTION

Figure 1:
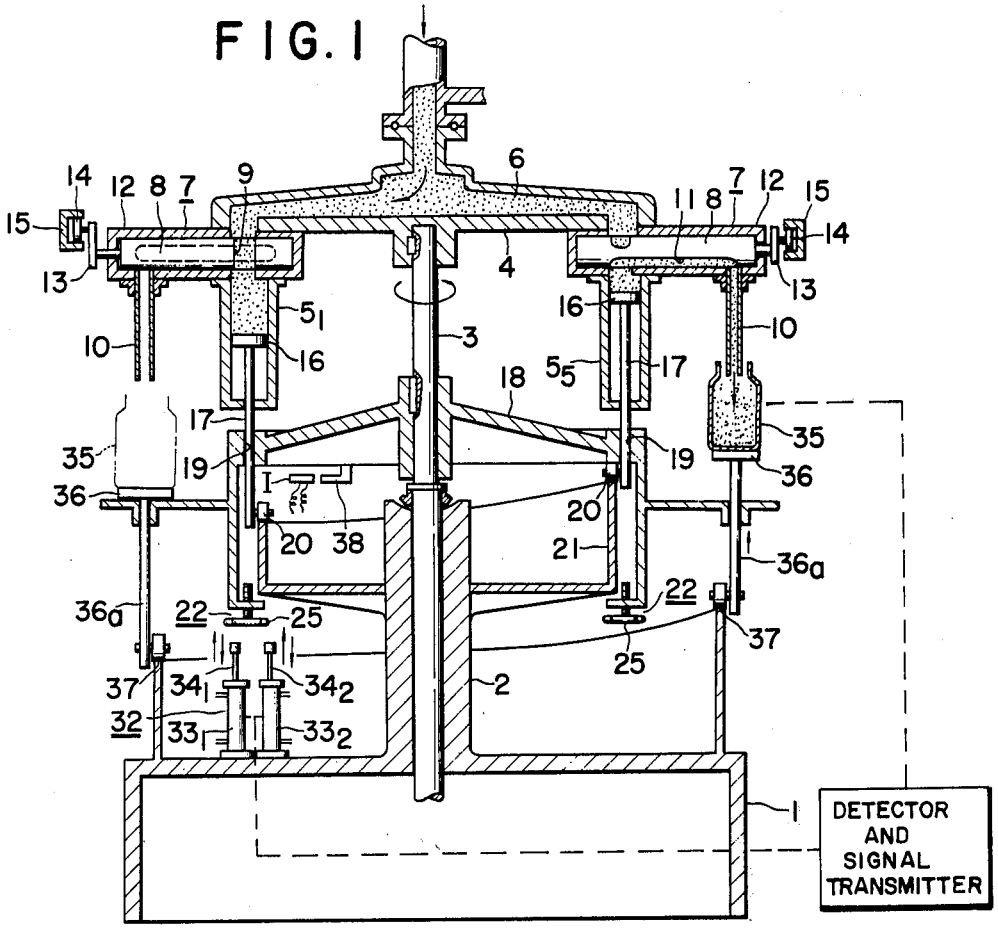
FIG. 1 is an elevation, in vertical section, showing one example of a rotary-type filling machine in which this invention is applied.

Referring first to FIG. 1, there is shown an embodiment of this invention applied in a rotary filling machine of the type wherein a material to be charged is sent under pressure. This machine has a base 1 having a central, upright bearing pedestal 2 rotatably supporting a vertical main spindle or shaft 3, which is driven by means not shown and supports at its upper end a revolving support structure 4 fixed thereto. This support structure 4 supports therearound a plurality of charging cylinders $5_1, 5_2, \ldots 5_8$ arranged upright in a circle. These charging cylinders $5_1$ through $5_8$ are supplied with a fluid to be charged from a material header chamber 6 formed at the central part of the support structure 4 and communicating at its center with a pressure tank (not shown).

Between the header chamber 6 and each cylinder 5, there is provided a switching valve 7 comprising an external casing 12, a rotatable cylindrical valve member 8, and a mechanism for actuating the valve member 8. The valve member 8 is provided therein with a passageway 9 for communicating the header chamber 6 with the interior of the charging cylinder 5 and a passageway 11 for communicating the interior of the charging cylinder 5 with a filling nozzle 10. These communications are established alternately in accordance with the rotational position of the valve member 8 which is rotated by above mentioned actuating mechanism through a shaft fixed coaxially to one end of the valve member 8 and extending outward through the casing 12.

The actuating mechanism comprises an arm 13 fixed at its proximal end to the above mentioned shaft, a roller 14 rotatably supported at the distal end of the arm 13, and an annular cam rail 15 engaged and followed by the roller 14. The cam rail 15 is fixed in space relative to the machine base 1. Accordingly, as the support structure revolves around its vertical rotational axis, undulations of the cam rail 15 are transmitted through the actuating mechanism to rotate the valve member 8, thereby to effect switching between the valve passageways 9 and 11.

Each charging cylinder 5 is provided therein with a piston 16 having a downwardly extending piston rod 17, which is inserted through a hole 19 in a revolving machine frame 18 fixed to the main shaft 3. The piston rod 17 is provided on one side thereof near its lower end with a roller 20 rollably engaged with and following an annular cam 21 formed at one part of the base 1. Accordingly, as the main shaft 3 rotates, a vertical movement is imparted to the piston rod 17.

In accordance with this invention, the setting of the limiting position of descent of each piston rod 17 is accomplished by means of a limit adjusting mechanism 22 provided in correspondence with each charging cylinder 5 on a part of the revolving frame 18 as described below.

Figure 2:
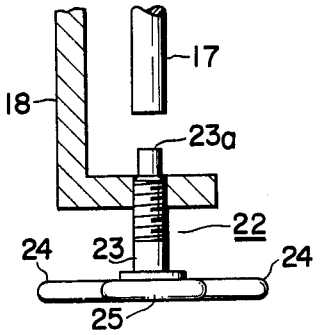
FIG. 2 is a relatively enlarged elevation showing one example of a limit adjusting mechanism.
Figure 4A:
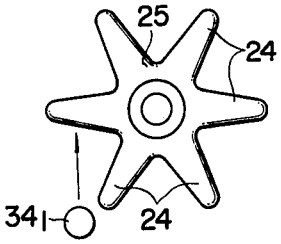
FIGS. 4(A) and 4(B) are plan views showing a rotation transmission wheel of the mechanisms shown in FIGS. 2 and 3 in relation to a piston rod for a description of the operation thereof.

In one example of this limit adjusting mechanism 22, as illustrated in FIG. 2, a screw threaded shaft or adjusting screw 23 is screwed upwardly through a part of the revolving machine frame 18 at a position directly below and coaxially aligned with the corresponding piston rod 17. To the lower end of this adjusting screw 23 is fixed a rotation transmitting wheel 25 having a plurality of outwardly radiating teeth 24, 24, as shown in FIG. 4(A). Accordingly, a rotation of this wheel 25, as described hereinafter, results in a vertical displacement of the position of the upper contact surface 23*a* of the adjusting screw 23 for abutting against the lower end of the piston rod 17.

Figure 3A:
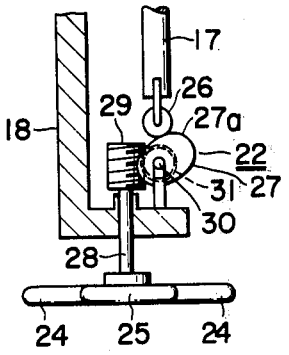
FIGS. 3(A) and 3(B) are similar relatively enlarged elevations respectively showing other examples of limit adjuting mechanism.

In another example of the limit adjusting mechanism 22, as shown in FIG. 3(A), a roller 26 is provided at the lower end of the piston rod 17 and caused to contact a cam 27 rotatably supported on a part of the revolving machine frame 18, the lower limit of descent of the piston rod 17 and the piston 16 being determined by the rotational position of the cam 27. A vertical rotatable shaft 28 is rotatably supported on the revolving machine frame 18 and is provided at its upper end with a worm 29 meshed with a worm wheel 31 fixedly mounted on a horizontal shaft 30, on which the cam 27 is also fixedly mounted. A rotation transmitting wheel 25 with outwardly radiating teeth 24, 24, similar to the wheel 25 in the preceding example is fixed to the lower end of the shaft 28. Accordingly, a rotation of the wheel 25 is transmitted to rotate the cam 27, thereby to cause the point of contact of the roller 26 on the cam surface 27*a* of the cam 27 to change, and thereby to vary the vertical position of the lower limit of descent of the piston 16.

Figure 3B:
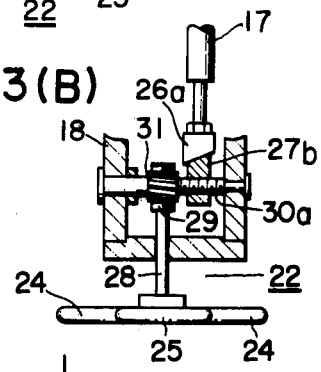

In still another example of the limit adjusting mechanism 22, as shown in FIG. 3(B), a rotation transmitting wheel 25 with teeth 24, 24, a vertical shaft 28, a worm 29, and a worm wheel 31 are provided similarly as in the preceding second example. The instant mechanism 22 differs from that of the preceding example in that, instead of the horizontal shaft 30, a horizontal shaft 30*a* provided with screw threads and formed integrally and coaxially with the worm wheel 31 is used. The screw threads of this shaft 30*a* are meshed with female screw threads formed in a block 27*b* having an upper surface which is inclined relative to the horizontal plane and is adapted to be abuttingly contacted by a mating inclined surface at the bottom of a block 26*a* fixed at its upper part to the lower end of the corresponding piston rod 17. The block 27*b* is prevented from rotating and is caused to move only in a horizontal direction parallel to the axis of the threaded shaft 30*a* by a slide guide (not shown). By this mechanical arrangement, a rotation of the wheel 25 is transmitted through the worm 29 and worm wheel 31 to rotate the threaded shaft 30*a*, whereupon the block 27*b* is moved horizontally. This horizontal movement of the block 27*b* results in a variable adjustment of the lower limit of the descent of the block 26*a* and therefore that of the piston rod 17.

In each of the above described three examples of the limit adjusting mechanism 22, consideration is given to preventing unintentional and excessive rotation of the adjusting screw 23 or the shaft 28 due to momentum by imparting suitable friction to the screw 23 or the shaft 28 or providing additionally a braking device.

The above described limit adjusting mechanism 22 is operated to set the lower limit of descent of the piston rod 17 by an actuating device 32, which comprises air cylinders $33_1$ and $33_2$ mounted vertically on the base 1 at spaced apart positions, respectively, on opposite sides of the path of revolution of the downward extension of the centerline of the adjusting screw 23 or the rotatable shaft 28 and having piston rods $34_1$ and $34_2$, respectively. This actuating device 32 is so adapted that the piston rods $34_1$ and $34_2$ can be extended upward to respective positions on opposite sides of the above mentioned path where either will engage with a tooth 24 of the wheel 25. The side (or air cylinder) which rotates the rotation transmitting wheel 25 in the direction for lowering the contact surface 23*a* or 27*a* will be referred to as the increasing side (or air cylinder), while that which rotates the wheel 25 in the direction for raising the contact surface will be referred to as the decreasing side (or air cylinder). In the instant example, the main shaft 3 is designed to rotate in the arrow direction, that is, counterclockwise, as viewed from above. Accordingly, when extended upwardly, the piston rods $34_1$ and $34_2$, respectively, turn a contacting wheel 25 in clockwise and counterclockwise directions, thereby to lower and raise the contact surface 23*a* or 27*a*. Therefore, the air cylinders $33_1$ and $33_2$ are respectively increasing and decreasing air cylinders. Both of the air cylinders are adapted to be remotely operable as described hereinafter.

The aforementioned filling nozzles 10 discharge the material to be charged into respective containers 35, each of which rests on a container platform 36 fixed to the upper end of a vertical slide rod 36*a*, which is slidably supported in a manner permitting only vertical sliding thereof by a part of the revolving machine frame 18. The lower part of the slide rod 36*a* is provided with a cam and follower mechanism 37 for raising the container platform 36 to its filling position.

A switch activating wiper 38 is mounted on a part integral with the main shaft 3 so as to rotate unitarily therewith. In a circle around the orbital path of the outer end of this activating wiper 38, proximity switches $I_1, I_2, \ldots I_8$ of the same number as and corresponding respectively to the charging cylinders $5_1, 5_2, .$ . . $5_8$ are installed at positions such that, immediately before each of the charging cylinders $5_1$ through $5_8$ reaches the point directly above the actuating device 32, the switch activating wiper 38 changes over the corresponding proximity switch I from OFF to ON. Then, as soon as each charging cylinder completes its passage over the actuating device 32, the proximity switch corresponding to this cylinder is changed over from On to OFF. The proximity switches $I_1$ through $I_8$ are electrically connected through respective relays $R_1$ through $R_8$ to a solenoid SOL for actuating the air cylinder for increasing the filling quantity of the actuating device 32.

Figure 5:
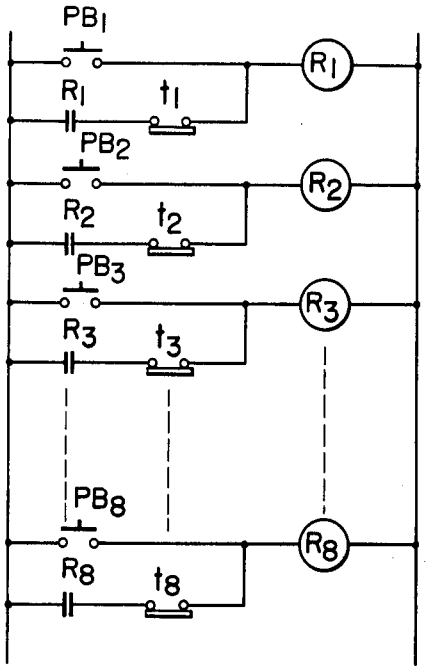
FIGS. 5 and 6 are partial circuit diagrams respectively showing parts of one example of an electrical control circuit for controlling an actuating device for actuating the rotation transmitting wheel.

Manually operable switches (pushbutton switches) $PB_1$ through $PB_8$, as shown in FIG. 5, are provided for selection of charging cylinders 5 needing variation of their filling quantities. In addition, contact points $t_1$ through $t_8$ of cam switches are provided respectively, for the charging cylinders $5_1$ through $5_8$. When a manually operable switch PB is depressed, the corresponding relay R operates, and the actuating device 32 operates with respect to a specific charging cylinder 5. Then, in order to prevent the actuating device 32 from operating again thereafter, even though a switch PB is not depressed, a timing cam (not shown) mounted on the main shaft 3 functions to cause the proximity switch I corresponding to the charging cylinder 5 passing over the actuating device 32 to be switched instantaneously to OFF at the instant when it is changed over from ON to OFF.

The circuit for decreasing filling quantity has a circuit organization similar to that of the above described circuit for increasing filling quantity and, therefore, will not be described.

The filling apparatus and the filling quantity regulating device according to this invention of the above described organization operate in the following manner.

A material to be charged into the containers 35 is delivered under pressure from a pressure tank (not shown) into the header chamber 6 to completely fill the same. Then, as the main shaft 3 rotates, each roller 14 of the aforementioned rollers 14 following the profile of the cam rail 15, upon arriving at a specific position, is actuated and displaced vertically by the cam rail 15, and this displacement is transmitted by way of the arm 13 to rotate the valve member 8 of the corresponding switching valve 7 to a rotational position where the header chamber 6 is made communicative by the passageway 9 with the interior of the corresponding charging cylinder 5. As a consequence, the material in the header chamber 6 is forced into the cylinder 5, and the piston 16 is forced downward by this charging force and its own weight in a manner determined by the cam surface of the cam structure 21. This action is indicated on the left-hand side of FIG. 1.

The lower limit of the stroke of each piston 16 is set by the height of the contact surface **23*a* or cam surface 27*a* of the corresponding limit adjusting mechanism 22. Therefore, the quantity of material charged into each charging cylinder 5 is determined by the vertical position of the corresponding contact surface 23*a* or cam surface 27*a*. At and near the lowermost position of the piston 16, its descent is no longer influenced by the cam surface of the cam structure 21**.

After the piston 16 has thus descended, and the cylinder 5 has thus been charged with the fluid material, the cylinder 5 approaches and arrives at a position for filling a container 35, whereupon actuation by the cam rail 15 is transmitted through the roller 14 and the arm 13 to rotate the valve member 8 to a rotational position where the interior of the charging cylinder 5 and the filling nozzle 10 are made communicative by the passageway 11 of the valve member 8. Furthermore, the piston 16 is forced upward by the cam 21 to discharge the material within the charging cylinder 5 out of this cylinder, through the filling nozzle, and into the container 35. This action is indicated on the right-hand side of FIG. 1. The above described operation is successively repeated by all other charging cylinders 5.

Figure 4B:
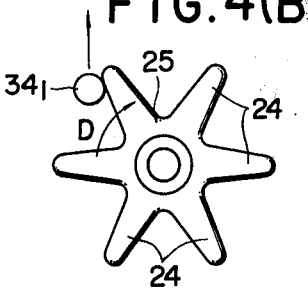

When the quantity of the material contained in any container thus filled is discovered by a spot check or sampling inspection or by weighing during conveying to be at variance with the specified quantity, compressed air is supplied to either the increasing or the decreasing air cylinder $33_1$ or $33_2$ immediately before the charging cylinder 5 from which that container was previously filled passes by the actuating device 32. The piston rod $34_1$ or $34_2$ of that air cylinder is thereby extended upward, and its upper end engages with one tooth 24 of the rotation transmitting wheel 25 of the limit adjusting mechanism 22 of the above mentioned charging cylinder 5, as indicated in FIGS. 4(A) and 4(B) for the case where the piston rod is $34_1$. Then, as this charging cylinder 5 revolves past the extended piston rod $34_1$ or $34_2$, the wheel 25 is turned through an angle of a magnitude sufficient for the travel of the piston rod relative to and past the wheel 25.

As a result of this turning of the wheel 25, the adjusting screw 23 and its contact surface **23*a* are raised or lowered in the example of the limit adjusting mechanism 22 illustrated in FIG. 2. In the example shown in FIG. 3(A), this turning of the wheel 25 rotates the rotatable shaft 28, and this rotation is transmitted through the worm 29 and worm gear 31 to rotate the cam 27, whereby the line of contact between the cam surface 27*a* and the roller 26 is raised or lowered. The lower limit of the stroke of the piston rod 17 and the piston 16 of the charging cylinder 5** requiring adjustment is thus finely adjusted, whereby the filling quantity of that cylinder is also adjusted.

By determining beforehand the variation of filling quantity brought about by the rotation of the rotation transmitting wheel 25 due to one tooth 24 in contacting a piston rod $34_1$ or $34_2$, or by so designing the various parts of the limit adjusting mechanism 22 and the actuating device 32 that the rotation due to one tooth 24 will vary the filling quantity by a desired quantity, the number of operations of the actuating device 32 required for a desired variation of the filling quantity can be readily determined. In this manner, accurate adjustment of the filling quantity is greatly facilitated.

Figure 6:
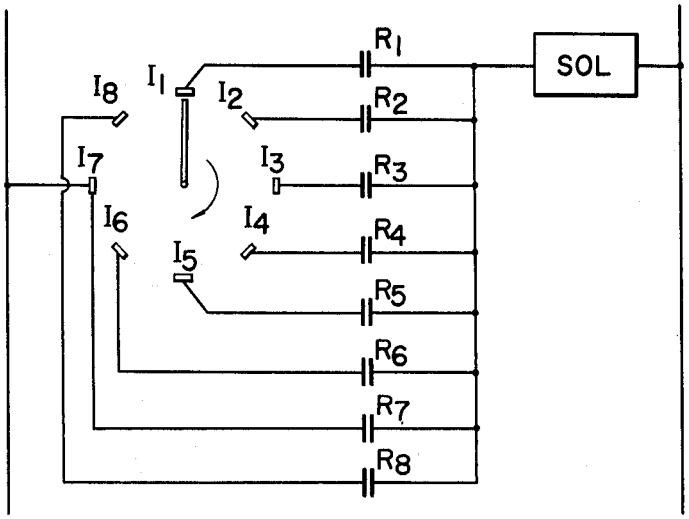

When the control means illustrated in FIGS. 5 and 6 is used, the switch PB corresponding to the charging cylinder 5 to be adjusted to increase its filling quantity is depressed beforehand, thereby to energize the relay R corresponding thereto and thereby to place its contact R in its ON state. Then, as the main shaft 3 rotates in the arrow direction in FIG. 1, the switch activating wiper 38 also rotates and approaches a proximity switch I corresponding to the circuit in which the above mentioned contact R is ON, whereupon the solenoid SOL is supplied with power, and pressurized air is sent to the air cylinder $33_1$ on the filling quantity increasing side of the actuating device 32. Consequently, the piston rod $34_1$ of this air cylinder rises, whereby the rotation transmitting wheel 25 of the limit adjusting mechanism 22 of the applicable charging cylinder 5 is turned clockwise, i.e., in the direction of the arrow D in FIG. 4(B). As a result, the corresponding contact surface 23*a* descends, and the filling quantity of that cylinder 5 is increased.

After the position of the contact surface 23*a* of the limit adjusting mechanism has been corrected in this manner, the switch activating wiper 38 separates from the proximity switch corresponding to the charging cylinder 5 whose filling quantity has been increased, and the power supply to the solenoid SOL is shut off.

Consequently, the piston rod $34_1$ descends. Simultaneously, as a result of the functioning of a timing cam (not shown) corresponding to the above mentioned charging cylinder 5, the corresponding cam switch operates, whereby its contact *t* becomes instantaneously OFF. As a consequence, the relay R of the same charging cylinder 5 is deenergized. Therefore, this charging cylinder 5 is not subjected to filling quantity correction a second time as long as the manually operated switch PB corresponding thereto is not depressed again.

The above described rotation transmitting wheel 25 is not limited in form to that described above, in which it is a kind of sprocket wheel with a plurality of teeth 24, but may be a friction wheel which is engaged frictionally by either of the piston rods $34_1$ and $34_2$ of the air cylinders $33_1$ and $33_2$. Moreover, solenoids may be used directly in the actuating device 32 in place of the air cylinders. Furthermore, the invention is not limited in its application to a filling machine of the above described type, wherein the material to be charged into containers is charged under pressure, but can be applied to the limit adjusting mechanism also of a filling machine of a type, for example, in which a roller 20 provided near the lower end of the piston rod of each piston 16 is clamped between upper and lower cam surfaces of a cam assembly having opposed, parallel cam surfaces, whereby the piston 16 is pulled down compulsorily, thereby to suck the filling material into the cylinder, and the lower limit of the stroke of the piston is determined by a limit adjusting mechanism of the invention which has a stroke stopping contact surface against which the lower end of the piston rod abuts and is stopped after a spring interposed between the piston and a fixed guide side is deflected.

Figure 7:
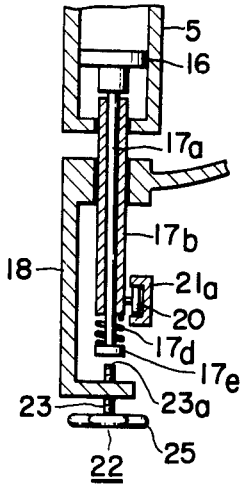
FIG. 7 is a relatively enlarged elevation, partly in vertical section, showing another example of a limit adjusting mechanism.

More specifically, as illustrated by one example in FIG. 7, each charging cylinder 5 has a piston 16 and a piston rod 17*a*, which is slidably inserted through a rod sleeve 17*b* supported at its lower end on the upper end of a compression coil spring 17*d* provided around the lower end of the piston rod 17*a* and in turn supported at its lower end on a retaining flange 17*e* fixed to the lower end of the piston rod 17*a*. The sleeve 17*b*, which is normally thus held at its uppermost position by the spring 17*d*, is provided near its lower end with a roller 20 engaged with an upper-lower surface cam 21*a*. Under the guidance and actuation by this cam 21*a*, the piston rod 17*a* normally undergoes vertical movement together with the rod sleeve 17*b*. When the piston 16 is thus pulled downward and nears the lower end of its stroke, the lower end of the piston rod 17*a* abuts against the contact surface 23 of the limit adjusting mechanism 22, whereupon the rod sleeve 17*b* descends under the guiding actuation of the cam 21*a*, thereby to compress the coil spring 17*d*, but the piston 16 is stopped from further descending since the lower end of its piston rod 17*a* is abutting against the contact surface 23.

Thus, as described above, this invention provides, in a filling apparatus of the above described character, a limit adjusting device by which the filling quantity of any of the plurality of cylinders can be automatically adjusted without stopping the operation of the filling apparatus. Therefore, the filling quantities of all cylinders can always be maintained accurately, and, at the same time, the operational efficiency can be remarkably elevated.

It should be understood, of course, that the foregoing disclosure relates to only preferred embodiments of the invention and that they are intended to cover all changes and modifications of the example of the invention herein chosen for the purposes of the disclosure, which do not constitute departures from the spirit and scope of the invention. For example, in addition to the possible modifications hereinbefore described, a plurality of pairs of the air cylinders $33_1$ and $33_2$ and their piston rods $34_1$ and $34_2$ can be installed, instead of the one pair described above, in a row along the orbital path of the rotation transmitting wheel 25. By this provision and appropriate application of control means, the adjustment of the lower limit of the intake stroke of each piston can be carried out quickly without the necessity of waiting for main shaft 3 to make a complete revolution before the wheel 25 can be rotated further by one tooth 24 thereof.

Furthermore, while a semiautomatic control system, as illustrated in FIGS. 5 and 6, has been described above, it is to be understood that this invention is intended to cover the case where the control system, either electrical or otherwise, is fully automatic, being operated in response to measuring signals generated in accordance with a detected quantity, such as the weight of each filled container measured by detection means in a downstream portion of the process line.

I claim:

1. In a container filling apparatus comprising a plurality of charging cylinders arranged in a circle around a vertical main shaft so as to revolve thereabout and provided with respective pistons for pushing out the material supplied into said cylinders to fill respective containers, a limiting adjusting mechanism provided for each of said charging cylinders and adapted for setting adjustably the limit end of the intake stroke of the piston in each charging cylinder, thereby to adjust the quantity of the material to be filled into each container, an actuating device for adjustably actuating said limit adjusting mechanism, and driving means for activating said actuating device thereby to cause adjustable operation of said limit adjusting mechanism, the improvement of said limit adjusting mechanism, said actuating device and said driving means:

said limit adjusting mechanism comprising a finely adjustable adjusting screw having a contact surface of one end thereof and engaged with a structural part secured integrally with and revolving unitarily with the corresponding charging cylinder, and a rotation transmitting wheel having sprocket-like teeth and fixed to the other end of said adjusting screw, said contact surface being adapted for abutment against the end part of a piston rod secured to the piston of said cylinder;

said actuating device comprising at least one pair of actuating members respectively disposed on opposite sides of the orbital path of revolution of said rotation transmitting wheel and adapted to be driven into engagement respectively with one sprocket-like tooth, thereby to turn said wheel respectively in clockwise or counterclockwise directions by an angular displacement corresponding to one tooth thereof; and said driving means being adapted for driving said actuating members into and out of said engagement.

2. A container filling apparatus as claimed in claim 1, in which the driving means comprises at least one pair of air cylinders having respective piston rods which constitute respectively the actuating members of the actuating device, and a control means comprising a pneumatic power system which is controllably operable to operate the air cylinders and an electrical control circuit for controllably operating said pneumatic control power system.

3. A container filling apparatus as claimed in claim 1, which comprises in combination therewith, weight detecting means adapted for detecting the weight of each container after it has been filled with the fluid material by a certain charging cylinder and adapted for transmitting to said driving means a detection signal corresponding to said weight thus detected, said driving means being adapted to operate when said detection signal indicates a weight deviating by a predetermined tolerance value from a preset standard weight to activate said actuating device and thereby to correct the filling quantity of said charging cylinder.

4. In a container filling apparatus comprising a plurality of charging cylinders arranged in a circle around a vertical main shaft so as to revolve thereabout and provided with respective pistons for pushing out the material supplied into said cylinders to fill respective containers, a limit adjusting mechanism provided for each of said charging cylinders and adapted for setting adjustably the limit end of the intake stroke of the piston in each charging cylinder, thereto to adjust the quantity of the material to be filled into each container, an actuating device for adjustably actuating said limit adjusting mechanism, and driving means for activating said actuating device thereby to cause adjustable operation of said limit adjusting mechanism, the improvement of said limit adjusting mechanism, said actuating device and said driving means:

each of said limit adjusting mechanisms comprising a cam constituting a finely adjustable member and having a variable cam surface, a cam shaft fixed at one pat thereof to said cam, a worm wheel fixed to said cam shaft at another part thereof, a worm meshed with said worm wheel, a rotatable shaft fixed at one end coaxially to said worm, and a rotation transmitting wheel coaxially fixed to the other end of said rotatable shaft and having sprocket-like teeth, said rotatable shaft being rotatably supported by a structural part secured integrally with and revolving unitarily with the corresponding charging cylinder and said cam surface of said cam being coupled with the lower part of the piston rod secured to the piston of the charing cylinder;

said actuating device comprising at least on pair of actuating members respectively disposed on opposite sides of the orbital path of revolution of said rotation transmitting wheel and adapted to be driven into engagement respectively with one sprocket-like tooth, thereby to turn said wheel respectively in a clockwise or counterclockwise direction by an angular displacement corresponding to one tooth thereof; and said driving means being adapted for driving said actuating members into or out of said engagement.

5. A container filling apparatus as claimed in claim 4, in which the driving means comprises at least one pair of air cylinders having respective piston rods which constitute respectively the actuating members of the actuating device, and a control means comprising a pneumatic power system which is controllably operable to operate the air cylinders and an electrical control circuit for controllably operating said pneumatic control power system.

6. A container filling apparatus as claimed in claim 4, which comprises in combination therewith, weight detecting means adapted for detecting the weight of each container after it has been filled with the fluid material by a certain charging cylinder and adapted for transmitting to said driving means a detection signal corresponding to said weight thus detected, said driving means being adapted to operate when said detection signal indicates a weight deviating by a predetermined tolerance value from a preset standard weight to activate said actuating device and thereby to correct the filling quantity of said charging cylinder.

7. In a container filling apparatus comprising a plurality of charging cylinders arranged in a circle around a vertical main shaft so as to revolve thereabout and provided with respective pistons for pushing out the material supplied into said cylinders to fill respective containers, a limit adjusting mechanism provided for each of said charging cylinders and adapted for setting adjustably the limit end of the intake stroke of the piston in each charging cylinder, thereby to adjust the quantity of the material to be filled into each container, an actuating device for adjustably actuating said limit adjusting mechanism, and driving means for activating said actuating device thereby to cause adjustable operation of said limit adjusting mechanism, the improvement of said limit adjusting mechanism, said actuating device and said driving means:

each of said limit adjusting mechanisms comprising a first block fixed to the lower end of the piston rod of the corresponding charging cylinder and having an inclined lower surface, a second block having an inclined upper surface adapted to abuttingly contact with said inclined surface of said first block and to set the lower limit of descent of said first block and, therefore, of said piston rod in accordance with the horizontal position of said second block, a horizontal threaded shaft screw-engaged with said second block and supported rotatably by a structural part secured integrally with and revolving unitarily with the corresponding charging cylinder, rotation of said shaft causing the second block to move horizontally, a worm wheel connected to and rotating with said threaded shaft, a worm meshed with said worm wheel, an adjusting shaft fixed coaxially at one end thereof to said worm, and a rotation transmitting wheel coaxially fixed to the other end of said adjusting shaft and having sprocket-like teeth, said adjusting shaft being rotatably supported by a structural part secured integrally with and revolving unitarily with the corresponding charging cylinder;

said actuating device comprising at least one pair of actuating members respectively disposed on opposite sides of the orbital path of revolution of said rotation and adapted to be driven into engagement respectively with one sprocket-like tooth, thereby to turn said wheel respectively in a clockwise or counterclockwise direction by an angular displacement corresponding to one tooth thereof; and said driving means being adapted for driving said actuating member into or out of said engagement.

8. A container filling apparatus as claimed in claim 7, in which the driving means comprises at least one pair of air cylinders having respective piston rods which constitute respectively the actuating members of the actuating device, and a control means comprising a pneumatic power system which is controllably operable to operate the air cylinders and an electrical control circuit for controllably operating said pneumatic control power system.

9. A container filling apparatus as claimed in claim 7, which comprises in combination therewith, weight detecting means adapted for detecting the weight of each container after it has been filled with the fluid material by a certain charging cylinder and adapted for transmitting to said driving means a detection signal corresponding to said weight thus detected, said driving means being adapted to operate when said detection signal indicates a weight deviating by a predetermined tolerance value from a preset standard weight to activate said actuating device and thereby to correct the filling quantity of said charging cylinder.

* * * * *